US007908676B2

(12) United States Patent
Gutshe

(10) Patent No.: US 7,908,676 B2
(45) Date of Patent: Mar. 22, 2011

(54) SHACKET™

(76) Inventor: Linda Gutshe, Minoqua, WI (US)

( * ) Notice: Subject to any disclaimer, the term of this patent is extended or adjusted under 35 U.S.C. 154(b) by 161 days.

(21) Appl. No.: 12/260,991

(22) Filed: Dec. 16, 2008

(65) Prior Publication Data

US 2010/0186137 A1 Jul. 29, 2010

Related U.S. Application Data

(63) Continuation-in-part of application No. 11/895,577, filed on Aug. 27, 2007, now abandoned.

(51) Int. Cl.
*A41D 15/04* (2006.01)
*A41F 18/00* (2006.01)

(52) U.S. Cl. ..... 2/301; 2/89

(58) Field of Classification Search ..... 2/89, 209.11, 2/301

See application file for complete search history.

(56) References Cited

U.S. PATENT DOCUMENTS

| | | | | |
|---|---|---|---|---|
| 4,594,735 | A * | 6/1986 | Rolf et al. | 2/89 |
| 4,703,521 | A * | 11/1987 | Asher et al. | 2/69 |
| 5,277,349 | A * | 1/1994 | Rowe | 224/154 |
| 6,341,379 | B1 * | 1/2002 | Kokus | 2/89 |
| 6,351,851 | B1 | 3/2002 | Yardan | |
| 2001/0025384 | A1 * | 10/2001 | Kester | 2/89 |

FOREIGN PATENT DOCUMENTS

WO WO 98/30127 7/1998

OTHER PUBLICATIONS

Sean Fallon, The IZAT Wearable Tent: Perfect for Line Camping, Oct. 2, 2007, http://www.gearfuse.com/the-izat-wearable-tent-perfect-for-line-camping.

Lichen, invented by Elliat Rich, http://www.abc.net.au/tv/newinventors/txt/s2160503.htm.

* cited by examiner

*Primary Examiner* — Bobby H Muromoto, Jr.

(74) *Attorney, Agent, or Firm* — Absolute Technology Law Group, LLC

(57) ABSTRACT

A multi-functional, lightweight outerwear garment that transforms into a temporary freestanding shelter.

12 Claims, 9 Drawing Sheets

SHACKET™

CLAIM OF PRIORITY

This application is a Continuation-in-Part Application which claims priority to U.S. patent application Ser. No. 11/895,577 filed on Aug. 27, 2007 now abandoned.

FIELD OF INVENTION

This invention relates generally to the field of multi-purpose and convertible garments. In particular, this invention relates to outerwear that may also function as a shelter.

BACKGROUND

Temporary shelters, such as tents and canopies are used for a number of outdoor activities such as outdoor sports (e.g., hiking, hunting, ice fishing, snowmobiling, hiking, biking). Many outdoor activities occur in part at distances from home on trails, in fields, on a lake, or other remote location that may require the use of a shelter, sometimes under variable weather conditions. Additionally, many social activities such as spectator sports, rallies and conventions require protection from the elements, particularly rain, wind and sun.

Many sports require a user to have their hands free to participate them, and a user would be encumbered by carrying heavy gear.

It is desirable to have a convenient means of storing a sheltering device in a wearable, multipurpose outer garment so that an individual is not required to use their hands to carry the items.

It is further desirable to have a lightweight sheltering device and means for carrying a sheltering device that is carefully balanced on a user's body during transport so as not to interfere with the user's coordination or agility in participating in the outdoor activity.

Many portable sheltering devices are known in the art, as well as means to make transporting and carrying them easier. For example, U.S. Pat. No. 6,421,834 (Kester '834) discloses a "convertible tent jacket" teaches an "interconvertible article of clothing which can be converted from a jacket form to a backpack form, the jacket having an oversized pocket concealed in the back panel of such jacket for holding a full size tent, a warning or signaling flag disposed on the tent pocket cover, a plurality of pockets on other areas of the jacket for storage of emergency blankets, first aid, and other survival necessities, and having shoulder straps and a waist belt for supporting and distributing the weight of the tent and carrying the backpack." This device, although directed at the problem of transporting portable shelters as a component of an outer garment, does not teach or enable the use of a free-standing tent, or a method for transport other than an oversized pocket into which the canvas portion of a tent may be stored, and does not address the need for a light-weight portable framework to support a tent structure.

It is desirable to have a means for storing tent poles and other structural components of a portable sheltering device during transport.

It is further desirable to have a device which is multi-functional as a jacket and portable sheltering device, and easily assembled and disassembled.

It is further desirable to have a portable sheltering device that can be erected on a variety of surfaces, including grassy surfaces, sandy surfaces, fields, muddy surfaces and solid flooring.

It is also desirable to introduce a novel item into the marketplace which amuses and surprises a user by concealing its functionality of as portable sheltering device, and which has a stylish appearance as a "field jacket" rather than as poncho or tentlike structure.

GLOSSARY

As used herein, the term "sheltering device" means any tent, portable shelter, canopy, umbrella or other equipment that provides an overhead shelter or barrier from environmental elements. A sheltering device may be three-sided, four-sided, five-sided or multi-faceted, and may be constructed of any plastic, canvas, metallic fabric or other material known in the art. A sheltering device may be assembled can be erected on a variety of surfaces, including grassy surfaces, sandy surfaces, fields, muddy surfaces and solid flooring.

As used herein, the term "SHACKET™" means a convertible, multi-purpose device object constructed of fabric, plastic, canvas, or other material that can be worn on the body as a barrier or as a temperature-insulating device and containing lightweight structural components to assemble a portable sheltering device.

As used herein, the term "panel" means a component of a SHACKET™ that may be zipped, attached, separated or configured to be both a component of a jacket and a component of a sheltering device. A SHACKET™ may include one or more front side and back panels that are attached, configured, zipped, released and positioned to form jacket and sheltering device components.

As used herein, the term "placket" means a component for concealing and/or protecting a zipper or zippered pocket by covering it. A placket may be a flap or protective barrier of any shape or size, of the same or different material as the SHACKET™ body.

As used herein, the term "pole pockets," may include loops, closures supports or other structures used to support and secure poles, or alternate materials and configurations which serve the function of pole pockets.

As used herein, the term "false hem" means the bottom border of a SHACKET™ in use as a jacket which gives the illusion of the end or border of a garment, but which actually contains additional fabric which is used as walls of a temporary shelter which is concealed.

As used herein, the term "sleeve tab" means an optional securing or closure mechanism on a sleeve cuff or lower portion of a sleeve.

As used herein, the term "separately assembled" means manufactured as separate components which may be jointed together at one or more seams or other attachment points.

SUMMARY OF THE INVENTION

The present invention is a multi-functional, lightweight outerwear garment that transforms into a temporary free-standing shelter. It consists of waterproof, breathable material that is hemmed and formed so that excess fabric and pole components are compressed or hidden and a user may wear the object as an everyday garment. When desired, the excess fabric and pole components may be released and opened and a user may construct a temporary, freestanding shelter using the same material.

DETAILED DESCRIPTION OF EMBODIMENTS OF THE INVENTION

Figure 1A:
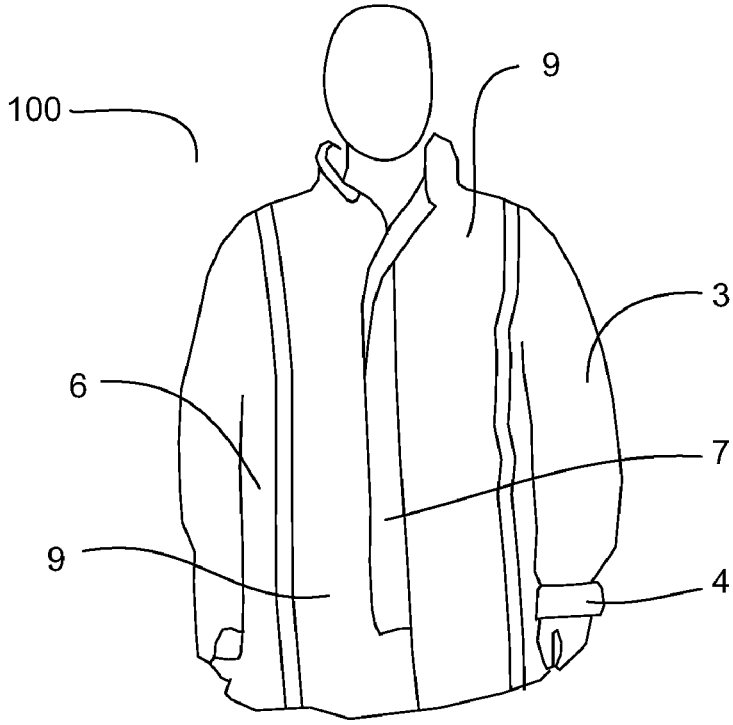
FIG. 1A illustrates a front view of the SHACKET™ in use as a jacket.

For the purpose of promoting an understanding of the present invention, references are made in the text hereof to embodiments of the SHACKET™, only some of which are described herein. It should nevertheless be understood that no limitations on the scope of the invention are thereby intended. One of ordinary skill in the art will readily appreciate those modifications such as more or fewer poles or support structures, or construction using varying materials as an outer garment or sheltering device component. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related.

Referring now to the drawings, FIG. 1A illustrates a front view of a SHACKET™ 100 in use as a jacket. When in use as a jacket, the functionality of SHACKET™ 100 as a temporary sheltering device in concealed. The jacket appears highly stylized and does not restrict the activities of the wearer in any manner, or encumber the wearer with significant weight from the structural components for assembling SHACKET™ 100 as a temporary shelter. In various embodiments SHACKET™ 100 may include a detachable inner lining (not shown) of fleece, wool, nylon, cotton, Gortex™ or other functionally comparable material which may be worn by a user while SHACKET™ 100 is being used in its capacity as a temporary structure.

Figure 1B:
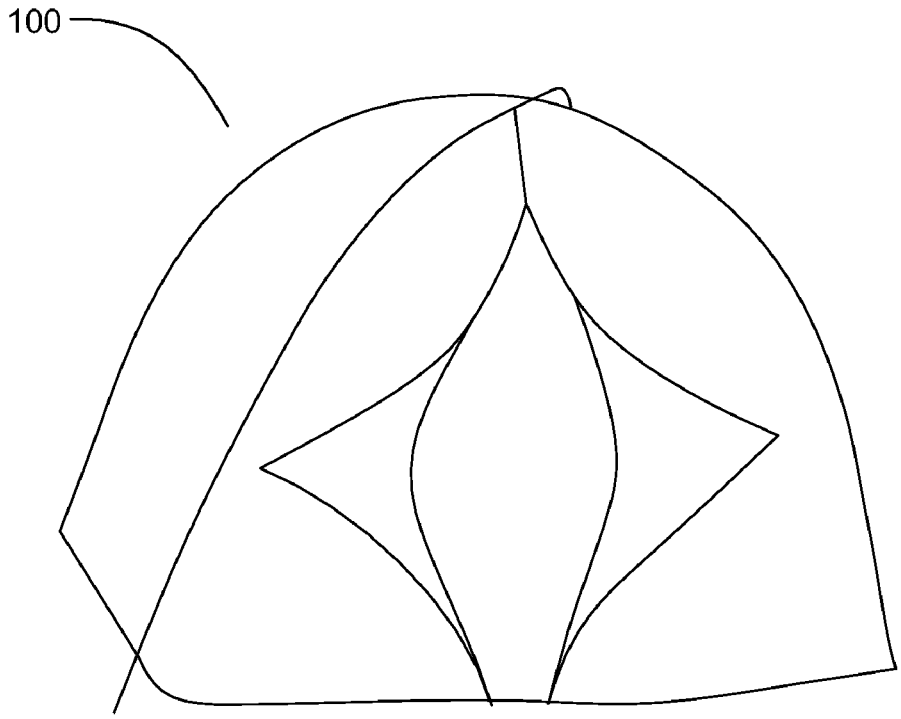
FIG. 1B illustrates a front view of the SHACKET™ in use as a shelter.

FIG. 1B shows a front view of the SHACKET™ 100 in use as a shelter.

In the embodiments shown in FIGS. 1A and 1B, SHACKET™ 100 is formed of materials that may vary for jacket and temporary shelter component parts, such as polar fleece, quilted, or other suitable material providing adequate insulation and protection from elements (e.g., waterproofing). The materials selected for the jacket components of the SHACKET™ 100 may be functional (e.g., insulation, warmth, sunscreen, ventilation, moisture barrier, camouflage) or have an aesthetic appeal (e.g., ornamental fabric, logo wear, decals and embellishment). The materials selected for the tent components of SHACKET™ 100 will be lightweight, durable, weather resistant, and easily compressed to be stored or folded within SHACKET™ 100 so as not to create undue bulk. Material used for the tent components of SHACKET™ 100 includes canvas, nylon or any other fabric possessing these qualities. Zippers and other closure components will be selected for durability, weight (e.g., plastic rather than metal zippers) and resistance to outdoor elements. It is estimated that a SHACKET™ 100 device and all component parts will not weigh more than four to twelve pounds, and the weight of such components (including the poles) will be distributed in a manner which will not affect a wearer's balance competitiveness or coordination in a particular sport. Elements visible in SHACKET™ include side panels 6, front panels 9 and back panels 13, placket 7, sleeves 3 and sleeve tab 4, further discussed infra.

Figure 2:
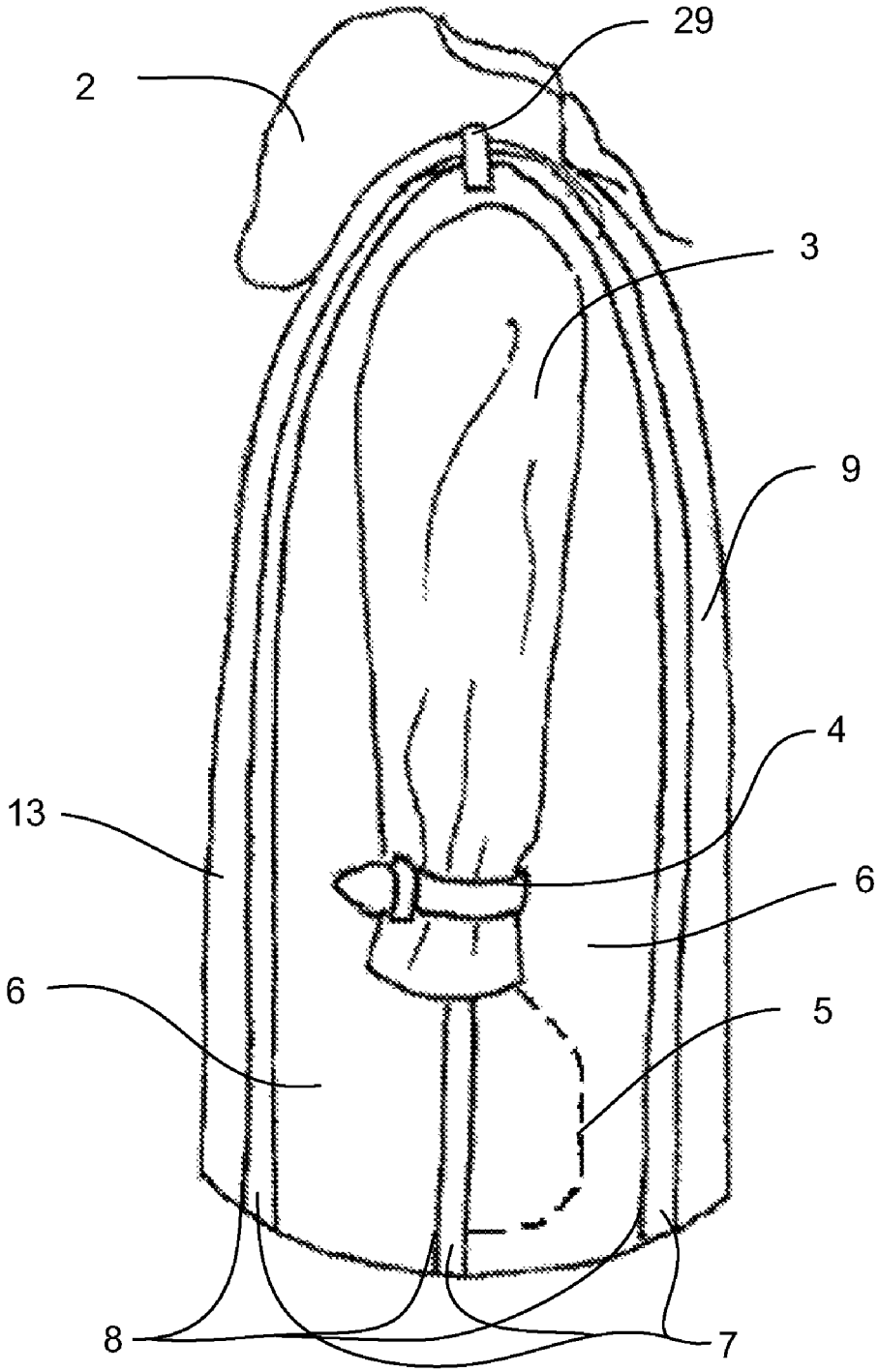
FIG. 2 illustrates a side view of the SHACKET™ in use as a jacket.

FIG. 2 illustrates a side view of the SHACKET™ in use as a jacket. As illustrated in FIG. 2 SHACKET™ 100 may include numerous outer garment components, including but not limited to sleeves 3, one or more sleeve tabs 4, one or more side panels 6, one or more front panels 9, one or more back panels 13. Additional embodiments of SHACKET™ 100 may include fewer or more panels, differently shaped panels, panels having different proportions, and panels having varying connection points and devices and not depart from the spirit of the invention.

Figure 4:
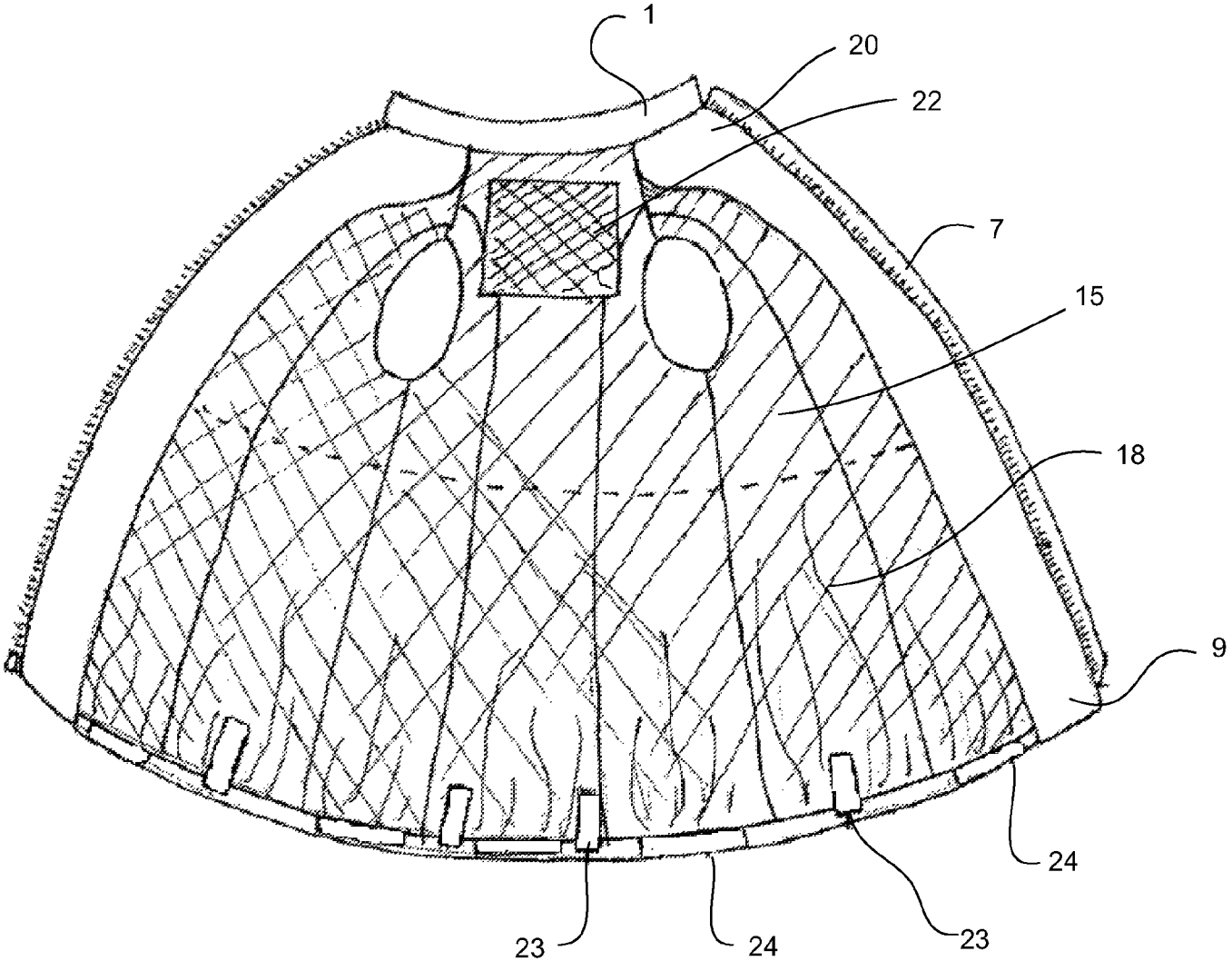
FIG. 4 illustrates a front inside view of the SHACKET™ in use as a jacket, in which the SHACKET™ lining is exposed.

SHACKET™ 100, as shown in FIG. 2, may further include optional ornamentation such as epaulets 29, and one or more pockets 5, which may be on the outer surface of SHACKET™ 100 or concealed within adjacent to lining 20 (shown in FIG. 4). In various embodiments, SHACKET™ 100 may further include various optional inner pockets (e.g., to hold food bars, compasses, maps, cell phone, matches, and other accessories and personal items).

In the embodiment shown in FIG. 2, zippers or other closure devices 8 selectively join one or more side panels 6, front panels 9, one or more back panels 13. Panels 6, 9 and 13 may conceal additional fabric, which serves to extend the surface area of SHACKET™ 100 when panels 6, 9 and 13 are opened and closed. In various embodiments, other closure means for panels may be used, as an alternative to zippers, including hooks, Velcro, snaps, stitching, temporary or permanent adhesive, buttons and loop devices. In the embodiment shown, closure devices 8 are zippers, covered by plackets 7 which are flaps for covering zippered pockets that may be ornamental (e.g., to conceal zippers or protect zippers from debris and outdoor elements and prolong their useful life).

Figure 3:
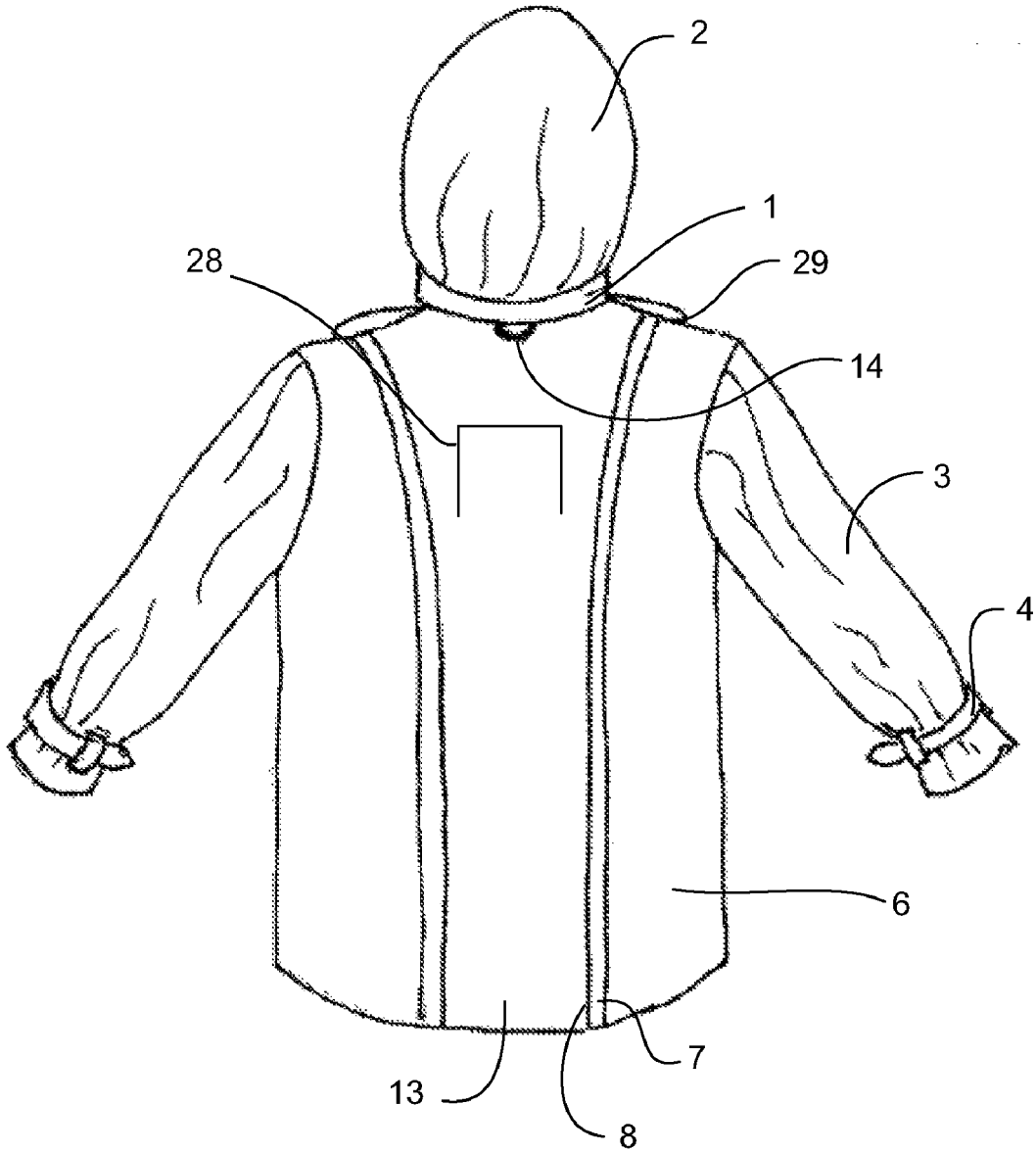
FIG. 3 illustrates a back view of the SHACKET™ in use as a jacket.

As illustrated in FIG. 2, SHACKET™ 100 further includes false hem 18 (shown in phantom) which gives the appearance of a traditional jacket hemline, but which actually includes an additional four (4) to eight (8) feet of false hem fabric (not shown) which is converted to the sides and "walls" of a temporary structure when SHACKET™ 100 is in use. In the embodiment shown, false hem fabric is sewn at the bottom of the jacket and folded and tucked up into the lining out of sight. In the embodiment shown, false hem fabric is held into place using various configurations and zippers and clips and is released to form walls of a temporary shelter. The false hem fabric may be any lightweight fabric suitable to outdoor use and providing varying degrees of wind resistance and insulation FIG. 3 illustrates a back view of the SHACKET™ in use as a jacket. As illustrated in FIG. 3, SHACKET™ 100 may further include one or more plackets 7. Plackets may be ornamental or functional. When included in an ornamental capacity plackets 7 give jacket a more stylized effect. Plackets 7 also serve the purpose of protecting closure device 8 and any other closure devices used in SHACKET™ 100 from outdoor elements and debris, prolonging the useful life and functionality of the closure device. (As discussed infra, SHACKET™ 100 may have multiple configurations of closure devices.)

The embodiment shown in FIG. 3 is a basic sleeve exhibiting no distortion. FIG. 3 further includes sleeve tab 4, which is located on the cuff portion of sleeve 3. In the embodiment shown, sleeve tab 4 is adapted to selectively tighten or loosen sleeve 3 around the wearer's wrist, and to close apertures in the sleeves when SHACKET™ 100 is in use as a temporary shelter.

As illustrated in FIGS. 2 and 3, SHACKET™ 100 further includes optional hood 2 and optional collar 1, both of which provide further protection from the elements and stylistic enhancement when SHACKET™ 100 is worn as a jacket and/or outer garment. Hood 2 and optional collar 1 may be detached, selectively attached or permanently attached. When not in use, in the embodiment shown, hood 2 and collar 1 may be folded, crushed, rolled or compressed to be inserted within storage compartment (not shown). In various embodiments, collar storage compartment may be a pocket, include snaps, Velcro, zippers or other closures.

In the embodiment shown in FIGS. 2 and 3, when SHACKET™ 100 is worn as an outer garment, the garment gives the stylistic appearance of a jacket, and has closures and sleeves 3 to encase the body. If SHACKET™ 100 is worn as an outer garment, it has a fitted appearance, rather than a "poncho" or tent like appearance, thus concealing its use as a garment which is convertible to a sheltering structure. As shown in FIGS. 2 and 3, SHACKET™ 100 is constructed in a manner so as not to restrict mobility or activities of the wearer.

FIG. 3 further illustrates pole pouch 28 this is a simple pouch for holding pole components of SHACKET™ 100, discussed infra. In the embodiment shown, pole pouch 28 is located on back panel 13 of SHACKET™ 100, but in other embodiments may be located on panels 6 or 9 or in any location that maintains comfort to a wearer of SHACKET™ 100 and substantially conceals poles.

FIG. 4 illustrates the inner lining of SHACKET™ 100. In the embodiment shown, collar 1 and hood 2 (not shown) partially form the roof of SHACKET™ 100 and channel pockets 29 which secure poles 26

FIG. 4 further illustrates floor pocket 22 which stores and conceals optional floor component 25 (not shown) to cover the ground or floor within SHACKET™ 100 when it is used as a temporary structure. In the embodiment shown, floor component 25 is a 5×5 piece of material but can be of any suitable dimensions for a particular shelter embodiment of SHACKET™ 100. In the embodiment shown, floor pocket 22 is found in the top of the center back lining 20 and holds optional floor component 25 (not shown) out of the way when traveling.

In the embodiment shown in FIG. 4, lining 20 stores and conceals triangular inserts 15 and 16 and false hem 18 by folding with clips, clasps, snaps or concealed pockets. In one exemplary embodiment, lining 20 is secured with a button to help hold the lining out of the way of the person sitting inside shelter formed from SHACKET™ 100. In various embodiments, lining 20 may further include dual pull buckles 23 and Velcro attachments 24 that attach lining 20 to false hem 18 or the jacket.

Figure 5:
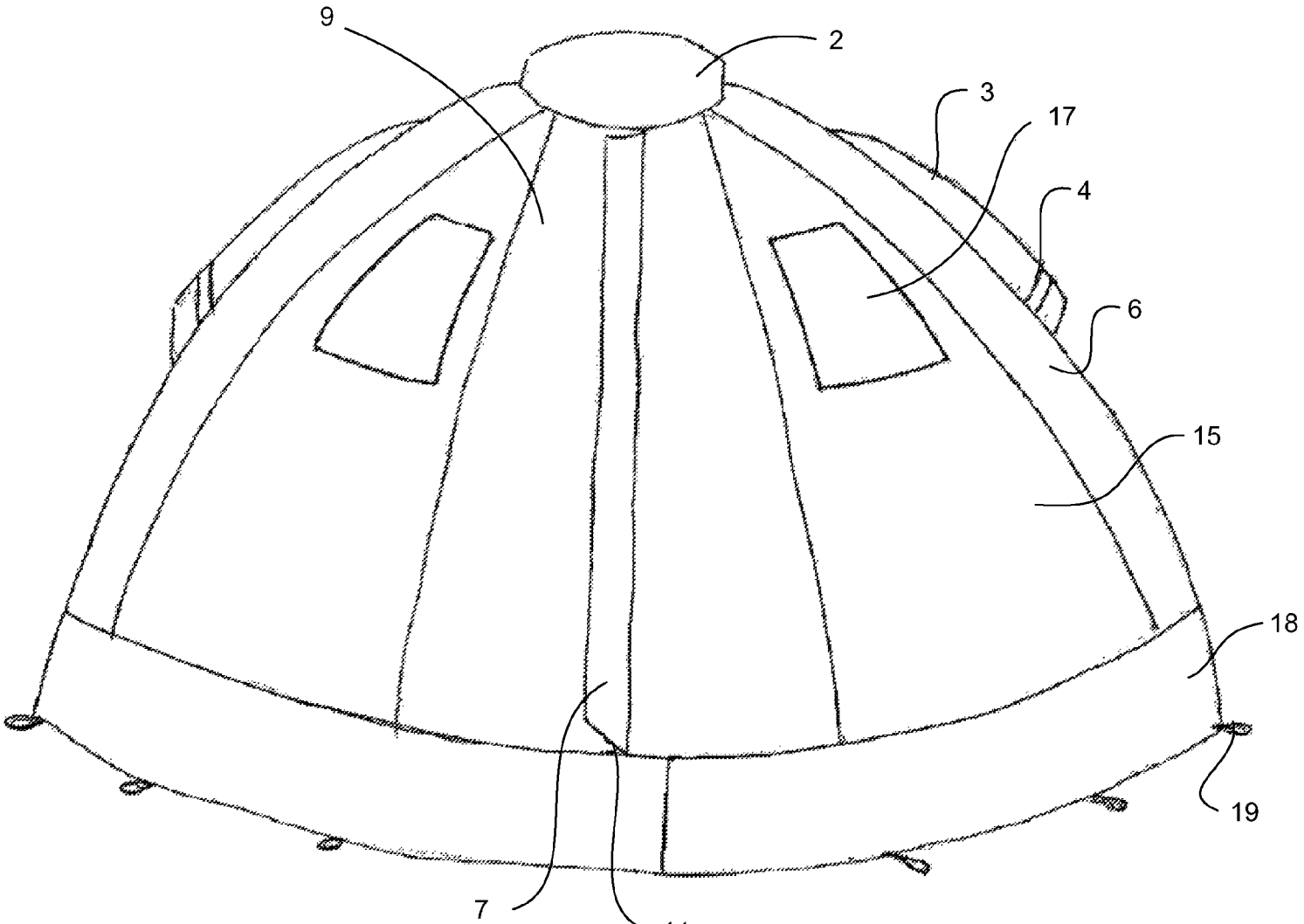
FIG. 5 illustrates a fully erected front view of the SHACKET™ in use as a shelter, in which the entrance is closed.

FIG. 5 illustrates SHACKET™ 100 in use as a freestanding portable shelter. SHACKET™ 100 is easily converted from a jacket to a portable shelter, and configures so that a user can follow a simple series of steps to unzip, unclip, pop up, and unfold SHACKET™ 100. To convert SHACKET™ 100 to a portable shelter, triangular fabric inserts 15 and 16 of varying sizes are released and opened to allow hidden fabric to increase surface area of SHACKET 100. Triangular fabric inserts 15 and 16 are selectively attached to front and back panels 6, 9 and 13. When in use as a jacket in the embodiment shown, inserts 15 and 16 are stored by tucking, folding, crushing or compressing, within pockets or the lining of SHACKET™ 100. The embodiment shown is dome-shaped, but can, in other embodiments, be rectangular, triangular, square or rounded. Further embodiments may be adapted to shelter more than one person. When the jacket is transformed into the shelter hood 2 becomes the roof cover.

In various embodiments, SHACKET™ 100 may be assembled as a freestanding shelter. SHACKET™ 100 serves the same purpose as any portable shelter device with either the help of stability with stakes and poles, or with a cord from an outer ring that can get support from a tree branch (which would also create a freestanding shelter). SHACKET™ 100 may further include fitting 14, e.g., a plastic hardware ID-ring which provides an alternative form of stability when the SHACKET™ 100 is used as a shelter. A rope, string, cord or other securing member may be fastened to fitting 14 and then secured to another object, (e.g., tied around a branch of a tree) to create an "A" frame shelter.

As illustrated in FIG. 5, various embodiments of SHACKET™ 100 may include windows 17 (optional) that can be created in plastic, mesh or any other fabrics to allow light or air to enter the temporary shelter.

Figure 6:
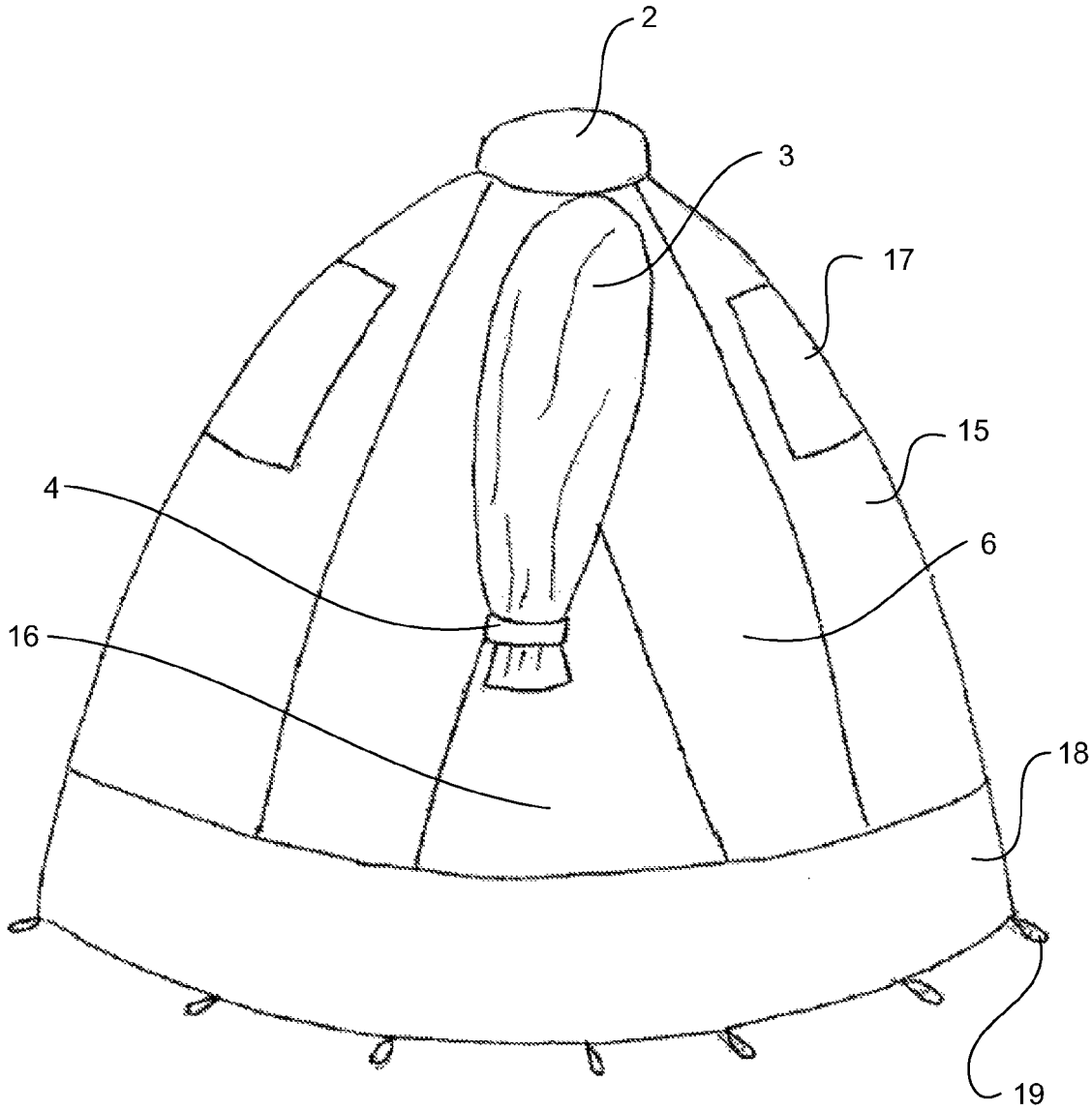
FIG. 6 illustrates a fully erected side view of the SHACKET™ in use as a shelter, in which the entrance is closed.

FIG. 6 illustrates a fully erected side view of SHACKET™ 100 in use as a shelter, in which the entrance is closed. In the embodiment shown, triangular insert 16 is shown below sleeve hem to allow consistent fabric levels when SHACKET™ 100 is transformed from jacket to shelter.

FIG. 6 also illustrates stake loops 19, which can optionally be used to secure SHACKET™ 100 to the ground when in use as a shelter.

Figure 7:
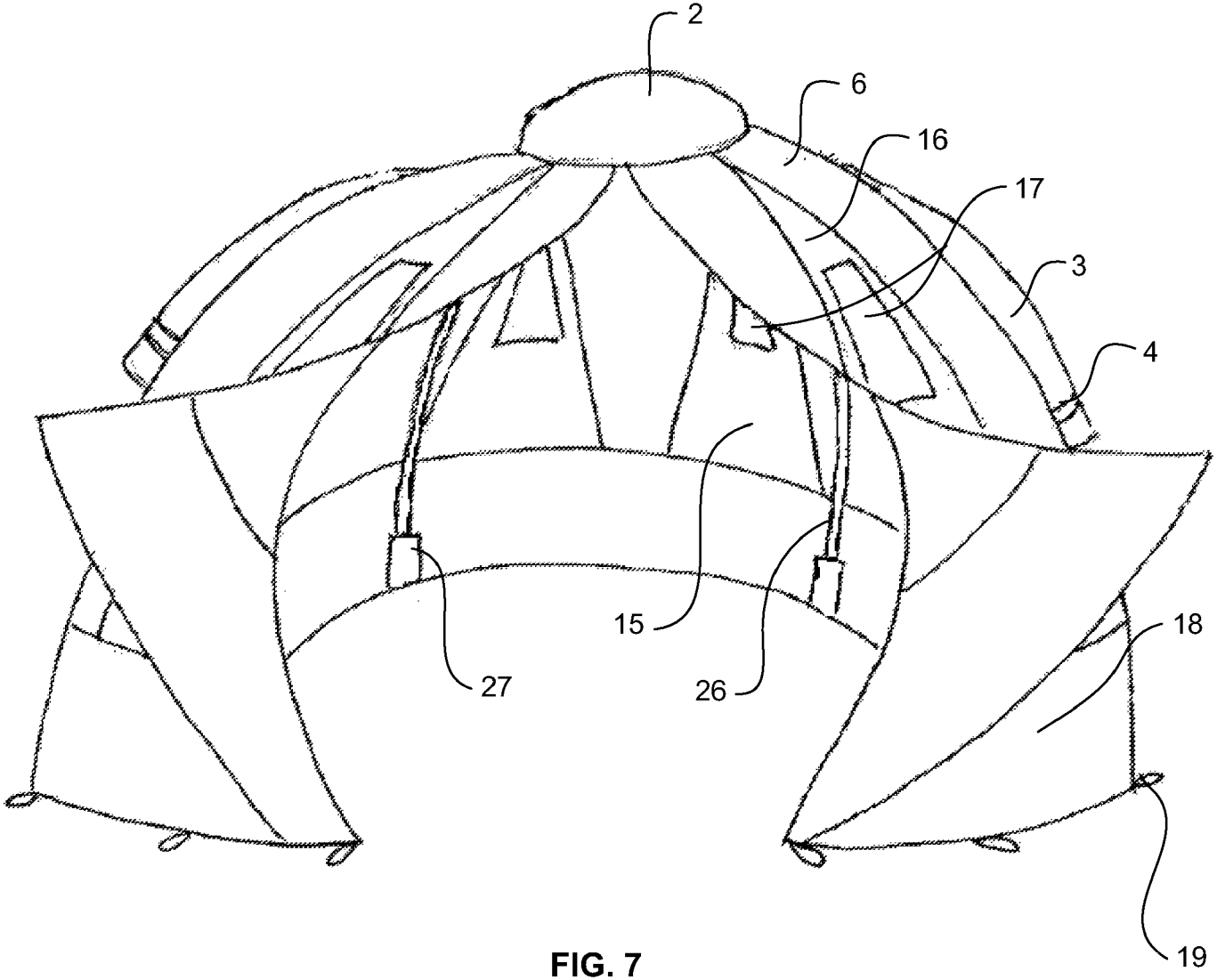
FIG. 7 illustrates an inside view of the SHACKET™ in use as a shelter, in which the entrance to the shelter is open.

FIG. 7 illustrates an interior view of SHACKET™ 100 in use as a shelter, in which poles 26 support SHACKET™ 100. Poles 26 are tent poles that have an internal diameter up to 1.5 inches, and are constructed of lightweight material such as fiberglass, aluminum, bendable bands or any other material known in the art. In the embodiment shown, poles 26 create a freestanding skeletal structure for the dome shape shelter. The poles are 18" long and fit into each of the other 5 sections. The two sets of poles are 90" total in length. Poles slide into each other with male and female parts. Six poles (16 inches) fits along shoulder like a quiver from shoulder to waist. How many pieces form each unit (144 inches).

FIG. 7 further illustrates that SHACKET™ 100, when in use as a shelter, contains pole pockets 27 to hold poles 26 in an arc position, and are located at the bottom inner walls of SHACKET™ 100. Pole pockets 27 accept the ends of poles 26, and when attached to fully erected and arced poles 26, extend fabric and create an enclosed, usable shelter. Pole pockets 27 serve to securely position SHACKET™ 100 when in use as a temporary shelter, as well as to provide support to the skeletal structure formed by poles 26, and to aid a user in constructing the temporary shelter. In the embodiment shown, pole pockets 26 are made from nylon belting, but may be made be made with plastic securing members, snapping or interlocking parts, or other sturdy fabric adapted to receive and secure poles 26.

For additional structural support, SHACKET™ 100 may contain a plurality of securing loops 19, as further shown in FIG. 7. Securing loops 19 may be attached along the bottom walls of SHACKET™ 100 and may be staked or otherwise secured to the ground. In the embodiment shown, securing loops 19 are approximately 1 inch-wide nylon straps sewn at both ends to SHACKET™ 100 but may alternatively be pockets, plastic securing members or snapping or interlocking parts. Securing loops 19 may be used in conjunction with stakes or with pole pockets 27, which receive the ends of poles to secure the structure for use on solid flooring.

Figure 8:
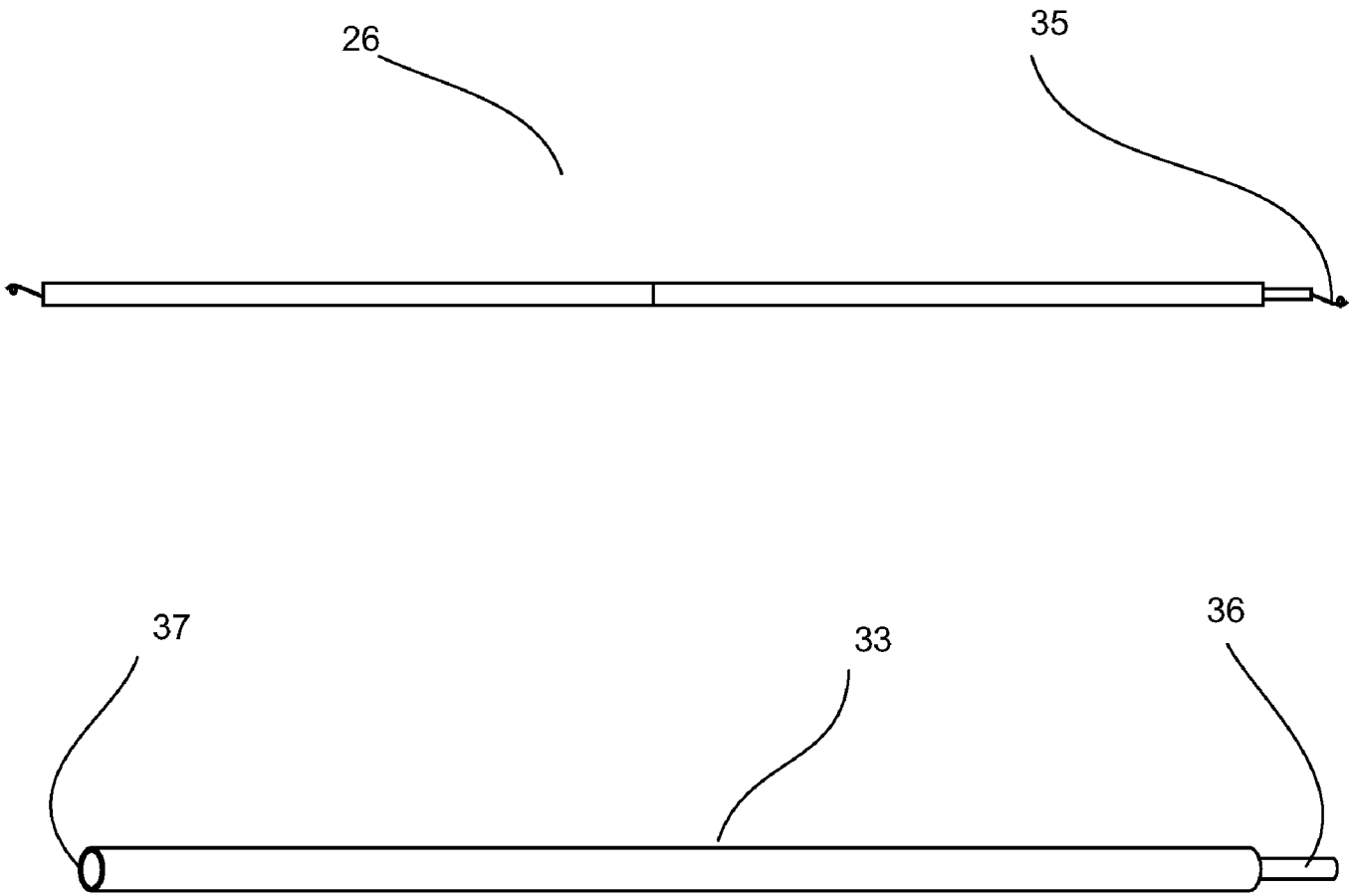
FIG. 8 illustrates pole segment in detached form for use in the SHACKET™.

FIG. 8 illustrates multiple pole segments 33 in a partially detached position, which are connected by a bungee 35 (or other elastic-type shock cord) and fold like a hinge when detached. Pole 26 is formed from pole segments 33 by straightening pole segments 33 and securing ferrule 36 into aperture 36, as shown in FIG. 8. Pole segments are stored in pole pouch 28 (shown in FIG. 3) which may extend across user's back and shoulder blades.

In the embodiment shown, fully erected poles 26 are inserted into pole pockets 27 (also not visible) and may be constructed of fiberglass, carbon fiber, flexible metal, or any other material sufficiently flexible so as to bend without snapping to form a curved structural element for SHACKET™ 100. In various embodiments, poles 26 may be tubular structures, hollow structures, strips or bands or constructed of one or multiple component parts which may be fixedly or selectively attached.

Figure 9:
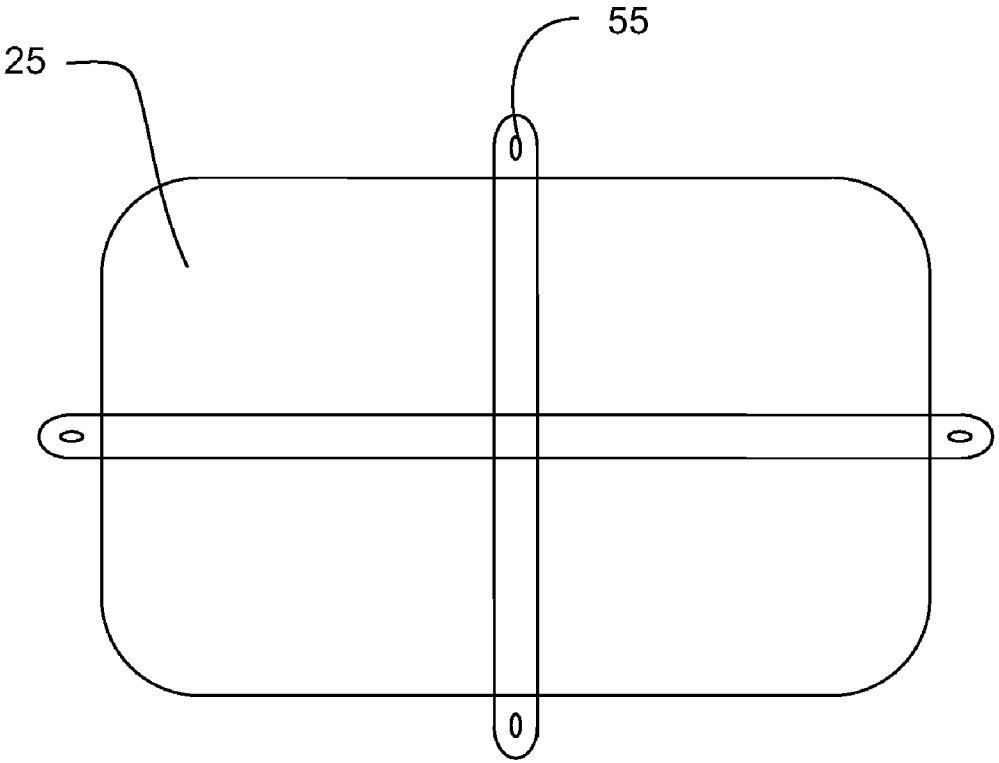
FIG. 9 illustrates the floor of a shelter, which may be used as the floor of a SHACKET™.

FIG. 9 illustrates an exemplary embodiment of floor component 25, which serves as a floor mat inside the shelter and includes corner pockets 55, into which poles 26 may be inserted to help in creating a sturdier shelter. Alternatively, SHACKET™ may be assembled as a floor mounted structure that does not need corner pockets 26.

What is claimed is:

1. A sheltering device comprised of:

a free standing skeletal structure comprised of two sets of flexible poles;

a plurality of pole pockets adapted to receive and secure the ends of said flexible poles in an arced position;

a dome structure having a fitted jacket component comprised of at least one separately assembled front panel, at least one separately assembled back panel, at least two separately assembled sleeved side panels; and a false hem for concealing at least one dome wall extension component;

wherein said at least one separately assembled front panel, at least one separately assembled back panel and at least two separately assembled side panels are selectively attached by at least one closure device concealed by a zipper concealing panel;

at least one dome wall inserts consisting of material fabric used for forming the walls of said dome sheltering device and adding additional surface area;

a dome wall extension component comprised of material fabric adapted to form walls of said sheltering device;

a dome structure frame comprised of a plurality of lightweight, selectively attachable pole components which are configured to form at least two flexible dome-support poles;

at least four pole pockets for securing the ends of said at least two flexible dome-support poles so that said at least two flexible dome-support poles arc to support a dome-shaped structure; and at least two channel pockets for securing said at least two arced flexible dome-support poles;

at least one back-centered pole pouch for storing said plurality of lightweight, selectively attachable pole components along the plane of a wearer's back;

at least one visibility component of a material selected from the group consisting of plastic, mesh, any material adapted to allow light into said dome sheltering device and combinations thereof; and at least two sleeve sealing components for sealing the sleeves when said fitted jacket component is used as said dome sheltering device.

2. The wearable sheltering device of claim one which further includes at least one hood which provides material to partially form the roof of said wearable sheltering device.

3. The wearable sheltering device of claim one which includes one or more securing loops.

4. The wearable sheltering device of claim one which weighs between 2 and 20 pounds.

5. The wearable sheltering device of claim one which further has the stylized appearance of a jacket and conceals the functionality of said device to serve as a temporary shelter.

6. The wearable sheltering device of claim one which further includes a floor component which contains one or more pole pockets for securing said poles on an indoor surface.

7. A sheltering device that has the stylized appearance of a jacket and conceals the functionality of said device to serve as a temporary shelter comprised of:

a free standing skeletal structure comprised of two sets of flexible poles;

a plurality of pole pockets adapted to receive and secure the ends of said flexible poles in an arced position;

a dome structure having a fitted jacket component comprised of at least one separately assembled front panel, at least one separately assembled back panel, at least two separately assembled sleeved side panels; and a false hem for concealing at least one dome wall extension component;

wherein said at least one separately assembled front panel, at least one separately assembled back panel and at least two separately assembled side panels are selectively attached by at least one closure device concealed by a zipper concealing panel;

at least one dome wall insert consisting of material fabric used for forming the walls of said dome sheltering device and adding additional surface area;

a dome wall extension component comprised of material fabric adapted to form walls of said sheltering device;

a dome structure frame comprised of a plurality of lightweight, selectively attachable pole components which are configured to form at least two flexible dome-support poles;

at least four pole pockets for securing the ends of said at least two flexible dome-support poles so that said at least two flexible dome-support poles arc to support a dome-shaped structure; and at least two channel pockets for securing said at least two arced flexible dome-support poles;

at least one back-centered pole pouch for storing said plurality of lightweight, selectively attachable pole components along the plane of a wearer's back;

at least one visibility component of a material selected from the group consisting of plastic, mesh, any material adapted to allow light into said dome sheltering device and combinations thereof;

at least two sleeve sealing components for sealing sleeves when said fitted jacket component is used as said dome sheltering device; and a hood which provides material to partially form the roof of said wearable sheltering device.

8. The wearable device of claim seven which further includes at least one optional component selected from a group consisting of a detachable lining, a window fabric, an epaulet, a fitting, a hook-and-loop attachment and a tie.

9. The wearable sheltering device of claim seven which includes a plurality of securing loops.

10. The wearable sheltering device of claim seven which weighs between 2 and 20 pounds.

11. A sheltering device that has the stylized appearance of a jacket and conceals the functionality of said device to serve as a temporary shelter comprised of:

a free standing skeletal structure comprised of two sets of flexible poles;

a plurality of pole pockets adapted to receive and secure the ends of said flexible poles in an arced position;

a dome structure having a fitted jacket component comprised of at least one separately assembled front panel, at least one separately assembled back panel, at least two separately assembled sleeved side panels; and a false hem for concealing at least one dome wall extension component;

wherein said at least one separately assembled front panel, at least one separately assembled back panel and at least two separately assembled side panels are selectively attached by at least one closure device concealed by a zipper concealing panel;

at least one dome wall inserts consisting of material fabric used for forming the walls of said dome sheltering device and adding additional surface area;

a dome wall extension component comprised of material fabric adapted to form walls of said dome sheltering device;

a dome structure frame comprised of a plurality of lightweight, selectively attachable pole components which are configured to form at least two flexible dome-support poles;

at least four pole pockets for securing the ends of said at least two flexible dome-support poles so that said at least two flexible dome-support poles arc to support a dome-shaped structure; and at least two channel pockets for securing said at least two arced flexible dome-support poles;

at least one back-centered pole pouch for storing said plurality of lightweight, selectively attachable pole components alone the plane of a wearer's back;

at least one visibility component of a material selected from the group consisting of plastic, mesh, any material adapted to allow light into said dome sheltering device and combinations thereof;

at least two sleeve sealing components for sealing sleeves when said fitted jacket component is used as said dome sheltering device;

a lining which conceals one of more components of a sheltering device;

a floor component which contains one or more pole pockets for securing said poles on an indoor surface; and a hood which provides material to partially form the roof of said wearable sheltering device.

12. The wearable sheltering device of claim eleven which further includes at least one optional component selected from a group consisting of a detachable lining, a window fabric, an epaulet, a fitting, a hook-and-loop attachment and a tie.

* * * * *